US008220891B2

(12) United States Patent
Oku

(10) Patent No.: US 8,220,891 B2
(45) Date of Patent: Jul. 17, 2012

(54) LIQUID DROPLET JETTING HEAD AND LIQUID DROPLET JETTING APPARATUS

(75) Inventor: Seiichiro Oku, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 275 days.

(21) Appl. No.: 12/707,679

(22) Filed: Feb. 18, 2010

(65) Prior Publication Data

US 2010/0225688 A1 Sep. 9, 2010

(30) Foreign Application Priority Data

Mar. 6, 2009 (JP) ..... 2009-053391

(51) Int. Cl.
*B41J 29/38* (2006.01)

(52) U.S. Cl. ..... 347/10

(58) Field of Classification Search ..... 347/9–11
See application file for complete search history.

(56) References Cited

U.S. PATENT DOCUMENTS 5,539,433 A * 7/1996 Kawai et al. ..... 347/13
6,493,109 B1 * 12/2002 Takamura et al. ..... 358/1.18
7,364,272 B2 * 4/2008 Furukawa et al. ..... 347/61

FOREIGN PATENT DOCUMENTS

JP 8-156257 A 6/1996
JP 11-263042 A 9/1999

* cited by examiner

*Primary Examiner* — An Do
(74) *Attorney, Agent, or Firm* — SOLARIS Intellectual Property Group, PLLC

(57) ABSTRACT

A liquid droplet jetting head includes: a first terminal to which is inputted a clock signal; a second terminal to which are serially inputted liquid droplet jetting-related input data in synchronization with the clock signal inputted to the first terminal and to which are serially inputted control data after the input data; a third terminal to which is inputted a pulse signal when input of the input data to the second terminal is completed; a first holding unit that holds the data inputted to the second terminal at a timing when the pulse signal is inputted to the third terminal; a delay unit that delays the pulse signal inputted to the third terminal; and a second holding unit that holds at least the control data inputted to the second terminal at a timing when the delay unit delays the pulse signal.

7 Claims, 3 Drawing Sheets

LIQUID DROPLET JETTING HEAD AND LIQUID DROPLET JETTING APPARATUS

CROSS-REFERENCE TO RELATED APPLICATION

This application is based on and claims priority under 35 USC 119 from Japanese Patent Application No. 2009-053391 filed on Mar. 6, 2009, the disclosure of which is incorporated by reference herein.

BACKGROUND

1. Technical Field

The present invention pertains to a liquid droplet jetting head and a liquid droplet jetting apparatus and relates particularly to a liquid droplet jetting head that is disposed in a liquid droplet jetting apparatus and jets liquid droplets.

2. Related Art

Conventionally, there have been known liquid droplet jetting apparatus such as inkjet printers that perform printing by jetting ink liquid from a liquid droplet jetting head onto a recording medium.

This liquid droplet jetting head drives, in accordance with an image to be printed, plural drive elements installed in the head. For example, in a liquid droplet jetting head equipped with piezoelectric elements such as piezo elements as the drive elements, liquid droplets are jetted from nozzles as a result of a voltage being applied in accordance with drive data such that the piezoelectric elements deform.

In Japanese Patent Application Laid-Open (JP-A) No. 8-156257 and JP-A No. 11-263042, there is described a liquid droplet jetting head to which, as control signals that control the liquid droplet jetting head, are inputted a clock signal representing a synchronization timing of drive data, a signal line to which drive data are inputted and a latch signal representing a latch timing.

In this type of liquid droplet jetting head, drive data equal to a single jetting are serially inputted to the signal line and are stored in order in shift registers in synchronization with the clock signal. Additionally, the drive data stored in the shift registers are latched and held in latch circuits at a timing when the latch signal is inputted. Additionally, a voltage is applied to the piezoelectric elements in accordance with the drive data held in the latch circuit and jetting of ink is performed.

Further, in a liquid droplet jetting head, an output terminal is disposed in the liquid droplet jetting head and the drive data of the last stage of the shift registers are outputted in order from the output terminal. This is performed for the purpose of feeding back the drive back to verify their contents and cascade-connecting a plurality of the liquid droplet jetting heads. The liquid droplet jetting heads described in JP-A No. 8-156257 and JP-A No. 11-263042 are also equipped with an output terminal that outputs the drive data.

Incidentally, in recent years, increasing the density, number of elements and speed of a liquid droplet jetting head is being sought after. For example, assuming a 2-inch wide liquid droplet jetting head whose printing density is 1200 dpi, the number of drive elements reaches as much as 2400 elements per head.

When the number of drive elements significantly increases in this manner, there is a limit on transfer speed when serially transferring, with one signal line, drive data equal to a single jetting of each drive element. For this reason, a configuration that uses plural signal lines and performs serial transfer in parallel in each signal line is conceivable.

With such a configuration, the same number of output terminals and signal lines for feedback as the number of signal lines for input can become necessary when performing feedback of the drive data of each signal line. Further, in the case of a configuration that uses many of these heads, the affect thereof is even greater.

If the purpose is to check the drive data, a system that selects and sequentially checks one of the plural signal lines, for example, is also conceivable. However, in that case, it is necessary to transmit a selection control signal to the liquid droplet jetting head. Thus, eventually a terminal becomes necessary in order to input this selection control signal.

That is, it is necessary to increase the number of terminals for control data input in order to input each type of control data with respect to the liquid droplet jetting head.

SUMMARY

The present invention provides a liquid droplet jetting head and a liquid droplet jetting apparatus that can input control data without having to increase the number of terminals.

One aspect of the present invention is a liquid droplet jetting head comprising: a first terminal to which is inputted a clock signal representing a synchronization timing when serially inputting data; a second terminal to which are serially inputted liquid droplet jetting-related data of a first number of bits in synchronization with the clock signal inputted to the first terminal and to which are serially inputted control data of a second number of bits after the liquid droplet jetting-related data; a third terminal to which is inputted a pulse signal when input of the input data to the second terminal is completed; a first holding unit that has a data storage area at least equal to the first number of bits and holds the liquid droplet jetting-related data of the first number of bits inputted to the second terminal at a timing when the pulse signal is inputted to the third terminal; a delay unit that delays the pulse signal inputted to the third terminal by an amount at least equal to the second number of bits in the clock signal; and a second holding unit that has a data storage area at least equal to the second number of bits and holds at least the control data of the second number of bits inputted to the second terminal at a timing when the delay unit delays the pulse signal by an amount at least equal to the second number of bits.

BRIEF DESCRIPTION OF THE DRAWINGS

Exemplary embodiments of the present invention will be described in detail based on the following figures, wherein.

DETAILED DESCRIPTION

A case where the present invention is applied to a liquid droplet jetting head disposed in an inkjet printer will be described below.

First Exemplary Embodiment

Figure 1:
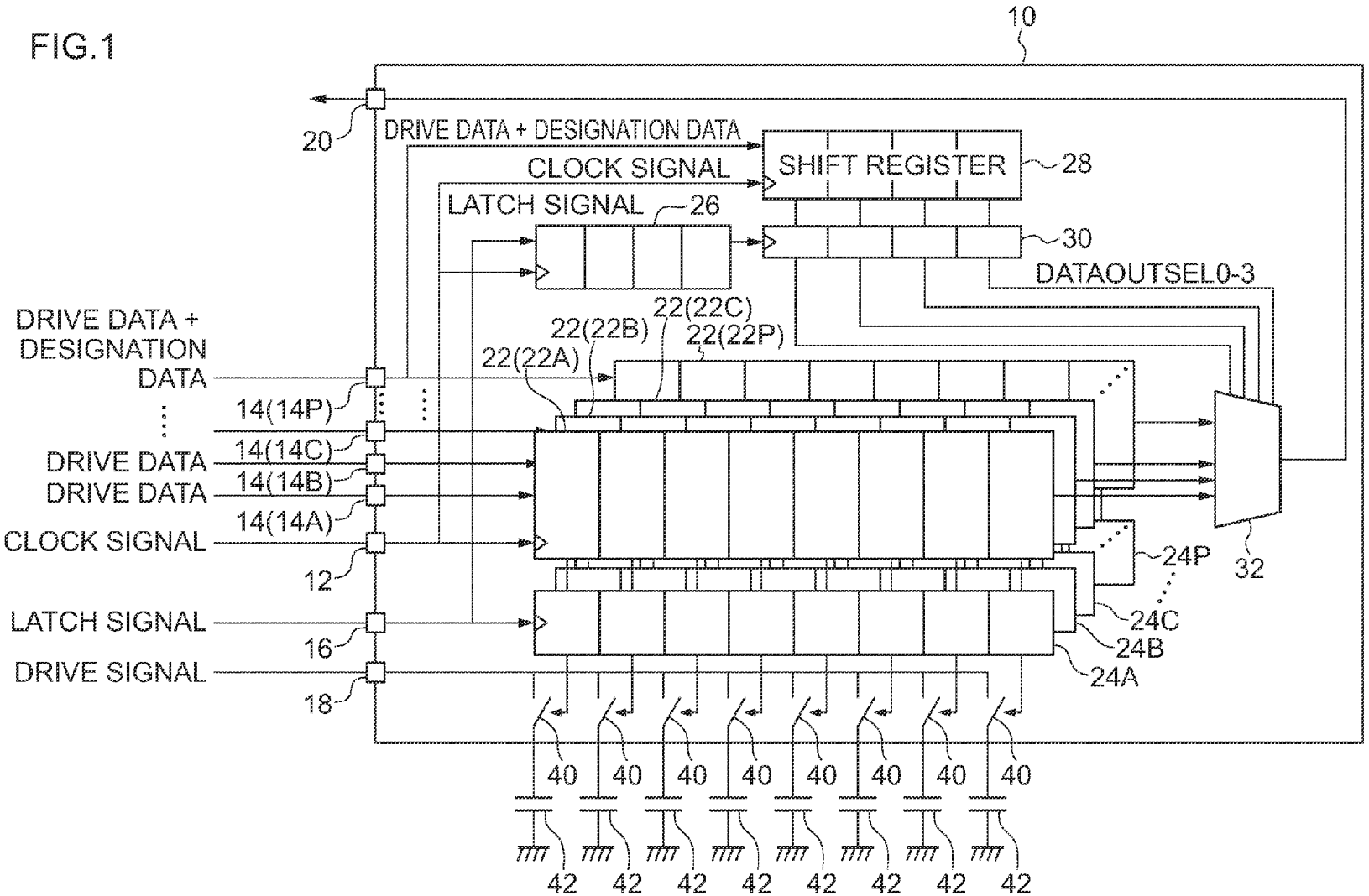
FIG. 1 is a diagram showing the general configuration of a liquid droplet jetting head pertaining to a first exemplary embodiment.

In FIG. 1, there is shown the general configuration of a liquid droplet jetting head 10 pertaining to the present exemplary embodiment.

The liquid droplet jetting head 10 is equipped with a clock terminal 12, a data terminal 14, a latch terminal 16, a drive signal terminal 18 and an output terminal 20. A clock signal representing a synchronization timing when serially inputting data is inputted to the clock terminal 12. Drive data are serially inputted to the data terminals 14 in synchronization with the clock signal inputted to the clock terminal 12. A latch signal is inputted to the latch terminal 16 when input of the drive data to the data terminals 14 is completed. A drive signal of a predetermined drive waveform is inputted to the drive signal terminal 18. The output terminal 20 outputs the drive data.

The liquid droplet jetting head 10 pertaining to the present exemplary embodiment is equipped with sixteen data terminals 14A to 14P in order to increase the speed of data transfer. Drive data of a predetermined number of bits are inputted to the data terminals 14A to 14P in synchronization with the clock signal. Moreover, designation data of a predetermined number of bits that designates data to be selected by a later-described selector 32 is inputted to the data terminal 14P after the drive data.

Further, the liquid droplet jetting head 10 is also equipped with sixteen shift registers 22A to 22P, latch circuits 24A to 24P, a delay circuit 26, a shift register 28, a latch circuit 30 and the selector 32.

The data terminals 14A to 14P are respectively individually connected to the shift registers 22A to 22P. The data terminal 14P is further connected to the shift register 28. The clock terminal 12 is connected to each shift register 22A to 22P, the delay circuit 26 and the shift register 28. The latch terminal 16 is connected to the latch circuits 24A to 24P and the delay circuit 26.

The shift registers 22A to 22P and the shift register 28 are, for example, given a configuration where plural flip-flop circuits are connected in series, with the flip-flop circuits having a storage area equal to 1 bit. The shift registers 22A to 22P and the shift register 28 are configured such that, each time the clock signal is inputted from the clock terminal 12, the shift registers 22A to 22P and the shift register 28 output, to a later stage, the data that each flip-flop circuit stores in itself and store the data inputted from a previous stage. That is, in the shift registers 22A to 22P and the shift register 28, each time the clock signal is inputted, the data inputted from the data terminals 14A to 14P sequentially move through each flip-flop circuit and are outputted from the flip-flop circuit of the last stage.

The shift registers 22A to 22P have storage areas equal to the drive data inputted to each data terminal 14 when causing liquid droplets to be jetted one time. In the present exemplary embodiment, the drive data inputted to each data terminal 14 when causing liquid droplets to be jetted one time are 8 bits. Thus, the shift registers 22A to 22P have storage areas equal to 8 bits. The shift registers 22A to 22P are connected to the selector 32 and, each time the clock signal is inputted, output the data stored in the storage area of the last stage to the selector 32.

The shift register 28 has a storage area equal to the designation data inputted to the data terminal 14P. In the present exemplary embodiment, the designation data designates any one set from the sixteen sets of drive data inputted to the data terminals 14A to 14P. For this reason, the designation data inputted to the data terminal 14P when causing liquid droplets to be jetted one time is 4 bits (0 to 16 values). Thus, the shift register 28 has a storage area equal to 4 bits.

The latch circuits 24A to 24P are disposed in correspondence to the shift registers 22A to 22P and are respectively individually connected to the shift registers 22A to 22P. The latch circuits 24A to 24P respectively have, like the shift registers 22A to 22P, storage areas equal to the drive data. The latch circuits 24A to 24P latch and hold the data stored in the corresponding shift registers 22A to 22P at a timing when the clock signal is inputted from the latch terminal 16.

Switches 40 are connected per storage area to the latch circuits 24A to 24P.

Figure 3:
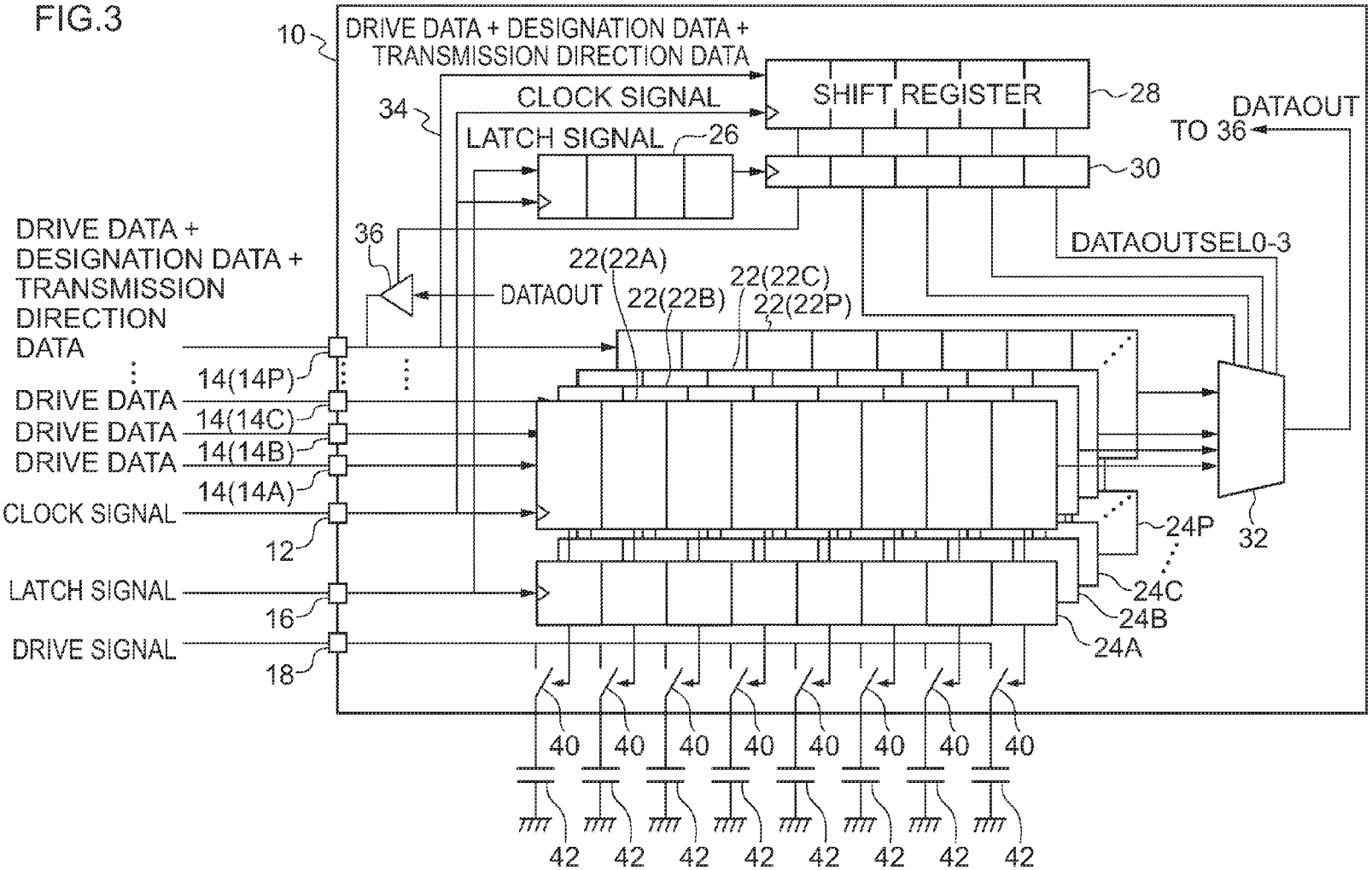
FIG. 3 is a diagram showing the general configuration of a liquid droplet jetting head pertaining to a second exemplary embodiment.

Each switch 40 is respectively connected to the drive signal terminal 18. The drive signal is inputted from the drive signal terminal 18. Each switch 40 controls the powered state of a piezoelectric element 42 such that the switch 40 switches ON and OFF in accordance with the state of the data held in each connected storage area of the latch circuits 24A to 24P. The liquid droplet jetting head 10 causes liquid droplets to be jetted from nozzles as a result of each switch 40 switching ON such that the drive signal is supplied to the piezoelectric element and the piezoelectric element deforms. It will be noted that, although it is not shown in the drawings here, eight each of the switches 40 and the piezoelectric elements 42 are connected to each of the shift registers 24A to 24P, so the number of jetting elements in the liquid droplet jetting head in the present exemplary embodiment is 128 (=8×16). The same is also true in the case of the second exemplary embodiment described later (FIG. 3).

The delay circuit 26 is, like the shift registers 22A to 22P and the shift register 28, given a configuration where plural flip-flop circuits are connected in series. Thus, the delay circuit 26 has a storage area equal to the designation data (here, equal to 4 bits). The delay circuit 26 delays, and outputs to the latch circuit 30, the latch signal inputted from the latch terminal 16 by an amount equal to the designation data (here, equal to 4 bits) in the clock signal inputted from the clock terminal 12.

The latch circuit 30 is connected to the shift register 28. The latch circuit 30 has, like the shift register 28, a storage area equal to the designation data. Thus, the latch circuit 30 latches and holds the data stored in the shift register 28 at a timing when the delayed latch signal is inputted from the delay circuit 26.

The selector 32 selects output data to be outputted to the outside from the data outputted from the shift registers 22A to 22P. Additionally, the selector 32 outputs the selected data to the output terminal 20.

Next, the action of the liquid droplet jetting head 10 pertaining to the present exemplary embodiment will be described with reference to FIG. 2.

When performing printing by jetting ink liquid, in the liquid droplet jetting head 10, the clock signal representing a synchronization timing is inputted with respect to the clock terminal 12 when causing liquid droplets to be jetted one time. Together with this, the sets of drive data of 8 bits each are respectively inputted to each data terminal 14A to 14P. Additionally, the latch signal is inputted to the latch terminal 16 when input of the drive data to the data terminal 14 is completed. Further, the designation data of 4 bits is inputted to the data terminal 14P after the drive data. It will be noted that, in FIG. 2, the input data inputted with respect to the data terminal 14P are shown.

The interval between the latch signals is the interval between driving of the elements, that is, the interval of ink jetting.

For example, in an inkjet printer where the liquid droplet jetting head 10 is reciprocally scanned to perform printing, it is necessary to adjust the ink jetting interval in accordance with the scanning speed of the liquid droplet jetting head 10. In such an inkjet printer, usually a signal corresponding to position is generated by an encoder or the like attached to the scanning drive system of the liquid droplet jetting head 10 and the latch signal is generated in synchronization with that.

Further, in an inkjet printer where the liquid droplet jetting head 10 is fixed and the recording medium (e.g., a sheet of paper) is moved with respect to the liquid droplet jetting head 10, the signal of an encoder of a conveyance system that conveys the recording medium is used.

Mechanical drive systems that reciprocally scan the liquid droplet jetting head 10 or move the recording medium have rotational and traveling variations. For this reason, the ink jetting interval fluctuates and the interval when the latch signal is inputted to the latch terminal 16 also fluctuates. For this reason, in the liquid droplet jetting head 10, ordinarily a predetermined margin period is disposed between the jetting interval and the drive data transfer period. Usually, valid data are not transferred in this margin period.

The liquid droplet jetting head 10 pertaining to the present exemplary embodiment uses this margin period to transfer the designation data.

The drive data inputted to each data terminal 14A to 14P are stored in the shift registers 22A to 22P and are latched and stored in the latch circuits 24A to 24P at a timing when the latch signal is inputted to the latch terminal 16. Each switch 40 switches ON and OFF on the basis of the drive data held in the latch circuits 24A to 24P. Additionally, liquid droplets are jetted from the nozzles as a result of the switches 40 switching ON such that the drive signal is supplied to the piezoelectric elements and the piezoelectric elements deform.

The latch signal is delayed by 4 bits in the clock signal by the delay circuit 26 and is outputted to the latch circuit 30. In synchronization with this delay of the latch signal by the delay circuit 26, the designation data is inputted from the data terminal 14P to the shift register 28.

The designation data inputted to the data terminal 14P is stored in the shift register 28 and is latched and held in the latch circuit 30 at a timing when the latch signal is delayed by the delay circuit 26.

Figure 2:
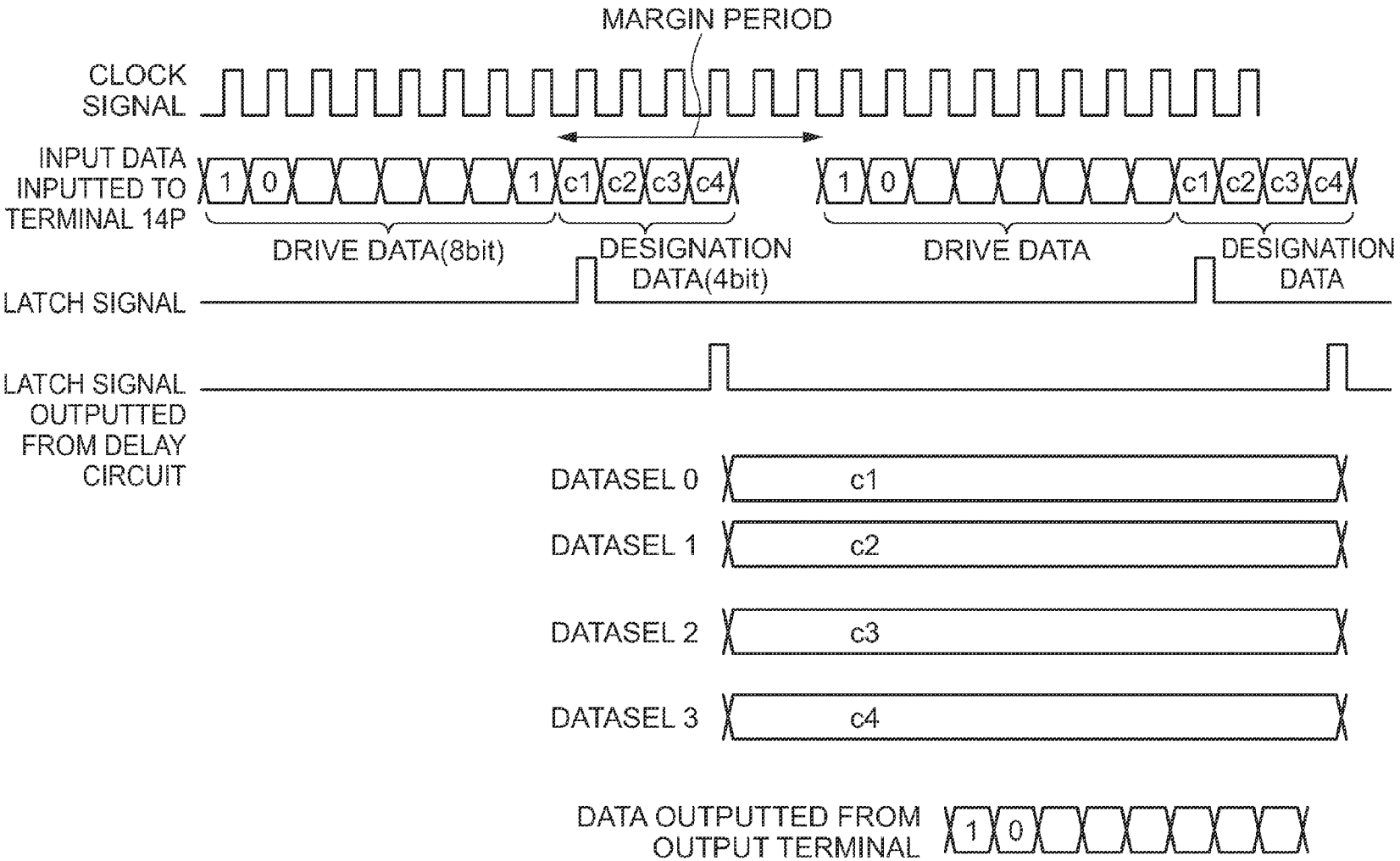
FIG. 2 is a waveform diagram showing operation of the liquid droplet jetting head pertaining to the first exemplary embodiment.

In FIG. 2, there is shown a state where sets of designation data C1 to C4 are respectively held (stored) in storage areas (DATASEL0 to DATASEL3) of the latch circuit 30 at a timing when the latch signal is outputted from the delay circuit 26.

The drive data stored in the shift registers 22A to 22P are outputted to the selector 32 in synchronization with the clock signal.

The selector 32 outputs, to the output terminal 20 on the basis of the designation data held in the latch circuit 30, the drive data inputted from the shift registers 22A to 22P designated by that designation data.

In this manner, according to the present exemplary embodiment, by using the margin period, the designation data can be inputted without having to separately dispose a terminal for inputting the designation data, and the designated drive data can be outputted.

Second Exemplary Embodiment

In FIG. 3, there is shown the general configuration of a liquid droplet jetting head 10 pertaining to the present exemplary embodiment. It will be noted that the same reference numerals will be given to portions that are the same as those in the preceding first exemplary embodiment (see FIG. 1) and that description of those same portions here will be omitted.

In the liquid droplet jetting head 10, a bidirectional buffer 36 is disposed in parallel to a line 34 that interconnects the data terminal 14P and the shift register 28. The bidirectional buffer 36 is also connected to the selector 32, and the most significant storage area of the latch circuit 30 is connected to the bidirectional buffer 36.

This bidirectional buffer 36 is configured by combining two tri-state buffers, for example, so that it can switch the data transmission direction. For example, the bidirectional buffer 36 outputs the data from the data terminal 14P to the shift register 28 when the data stored in the most significant storage area of the latch circuit 30 is 0 and outputs the data from the selector 32 to the data terminal 14P when the data stored in the most significant storage area of the latch circuit 30 is 1.

The aforementioned designation data and transmission direction data that designates the data transmission direction of the bidirectional buffer 36 are inputted in order to the data terminal 14P after the drive data.

The shift register 28 has a storage area equal to the designation data and the transmission direction data. In the present exemplary embodiment, the designation data is 4 bits and the transmission direction data is 1 bit. Thus, the shift register 28 has a storage area equal to 5 bits.

The delay circuit 26 also has a storage area equal to the designation data and the transmission direction data. The delay circuit 26 delays, and outputs to the latch circuit 30, the latch signal inputted from the latch terminal 16 by an amount equal to the designation data and the transmission direction data (here, equal to 5 bits) in the clock signal inputted from the clock terminal 12.

Next, the action of the liquid droplet jetting head 10 pertaining to the present exemplary embodiment will be described.

When performing printing by jetting ink liquid, in the liquid droplet jetting head 10, the clock signal representing a synchronization timing is inputted with respect to the clock terminal 12 when causing liquid droplets to be jetted one time. Together with this, the sets of drive data of 8 bits each are respectively inputted to each data terminal 14A to 14P. Additionally, the latch signal is inputted to the latch terminal 16 when input of the drive data to the data terminal 14 is completed. Further, the designation data of 4 bits and the transmission direction data of 1 bit are inputted in order to the data terminal 14P after the drive data.

The drive data inputted to each data terminal 14A to 14P are stored in the shift registers 22A to 22P. Additionally, the drive data are latched and stored in the latch circuits 24A to 24P at a timing when the latch signal is inputted to the latch terminal 16. Additionally, each switch 40 switches ON and OFF on the basis of the stored drive data. Additionally, liquid droplets are jetted from the nozzles as a result of the switches 40 switching ON such that the drive signal is supplied to the piezoelectric elements and the piezoelectric elements deform.

The latch signal is delayed by 5 bits in the clock signal by the delay circuit 26 and is outputted to the latch circuit 30. In synchronization with this delay of the latch signal by the delay circuit 26, the designation data and the transmission direction data are inputted from the data terminal 14P to the shift register 28. Additionally, the designation data and the transmission direction data are latched in the latch circuit 30 at a timing when the latch signal is delayed by the delay circuit 26.

The selector 32 outputs, to the output terminal 20 on the basis of the designation data latched in the lower 4 bits of the latch circuit 30, the drive data inputted from the shift registers 22A to 22P designated by that designation data.

Meanwhile, the bidirectional buffer 36 switches the data transmission direction on the basis of the transmission direction data latched in the upper 1 bit of the latch circuit 30. By using 1 for this transmission direction data, the data from the selector 32 are outputted to the data terminal 14P.

In this manner, according to the present exemplary embodiment, the drive data designated by the designation data can be outputted without having to separately dispose the output terminal 20 for outputting the drive data.

Further, according to the present exemplary embodiment, because it is not necessary to separately dispose the output terminal 20, the number of terminals (signal lines) is the same as in a liquid droplet jetting head that does not have a drive data feedback function. Consequently, a feedback function can be newly added while maintaining compatibility with a liquid droplet jetting head that does not have a feedback function. By having compatibility in this manner, even when a conventional liquid droplet jetting head that does not have a feedback function is connected to an inkjet printer that uses the liquid droplet jetting head 10 pertaining to the present exemplary embodiment, the functions of the conventional head can be utilized as they are.

It will be noted that, in each of the preceding exemplary embodiments, a case has been described where the drive data serve as the input data of the present invention. However, the present invention is not limited to this. Further, a case has been described where the designation data and the transmission direction data serve as the control data of the present invention. However, the present invention is not limited to this.

Further, in each of the preceding exemplary embodiments, a case has been described where the designation data is inputted immediately after the drive data. However, the present invention is not limited to this; for example, there may also be an interval equal to a predetermined number of bits between the drive data and the designation data. In this case, it suffices for the delay circuit 26 to further delay by an amount equal to the predetermined number of bits of that interval.

Further, in the first exemplary embodiment, the shift register 28 and the latch circuit 30 have storage areas equal to the number of bits of the designation data. And in the second exemplary embodiment, the shift register 28 and the latch circuit 30 have storage areas equal to the number of bits of the designation data and the transmission direction data. However, the present invention is not limited to this; the shift register 28 and the latch circuit 30 may also have larger storage areas. In this case, the delay circuit 26 may further delay the latch signal in a range where the designation data and the transmission direction data are stored in the shift register 28.

Further, similarly, the shift registers 22A to 22P and the latch circuits 24A to 24P may also have larger storage areas than the number of bits of the drive data.

Further, in each of the preceding exemplary embodiments, a case has been described where the data terminal 14 is disposed plurally as the data terminals 14A to 14P and where the control data are inputted to the data terminal 14P after the input data. However, the present invention is not limited to this; for example, the data terminal 14 may be disposed singularly and the control data may be inputted to that data terminal 14 after the input data.

In addition, the configurations of the liquid droplet jetting head 10 described in the preceding exemplary embodiments (see FIG. 1 and FIG. 3) are only examples and can be changed depending on the situation in a scope that does not depart from the gist of the present invention.

In an aspect of the present invention that has been described above, a clock signal representing a synchronization timing when serially inputting data is inputted to a first terminal, liquid droplet jetting-related input data of a first number of bits are serially inputted to a second terminal in synchronization with the clock signal inputted to the first terminal, control data of a second number of bits are serially inputted to the second terminal after the liquid droplet jetting-related data, and a pulse signal is inputted to a third terminal when input of the input data to the second terminal is completed.

In the above-described aspect, a first holding unit that has a data storage area at least equal to the first number of bits holds the data of the first number of bits inputted to the second terminal at a timing when the pulse signal is inputted to the third terminal. Thus, the input data are held by the first holding unit.

Further, in the above-described aspect, a delay unit delays the pulse signal inputted to the third terminal by an amount at least equal to the second number of bits in the clock signal.

Additionally, in the above-described aspect, a second holding unit that has a data storage area at least equal to the second number of bits holds at least the data of the second number of bits inputted to the second terminal at a timing when the delay unit delays the pulse signal by an amount at least equal to the second number of bits. Thus, the control data are held by the second holding unit.

In this manner, according to the above-described aspect, the input data and the control data serially inputted to the first terminal can be separated such that the input data are held in the first holding unit and the control data are held in the second holding unit, so control data can be inputted without having to increase the number of terminals.

It will be noted that, in another aspect pertaining to the present invention, the liquid droplet jetting head may also be configured to include: a plurality of the second terminals, with the liquid droplet jetting-related data being serially inputted at the same time to each of the plurality of the second terminals in synchronization with the clock signal and with the control data being serially inputted to any one of the plurality of the second terminals after the liquid droplet jetting-related data; and a plurality of the first holding units, with the plurality of the first holding units being disposed in correspondence to the plurality of the second terminals and with each of the plurality of the first holding units holding at least data of the first number of bits inputted to the corresponding second terminals at a timing when the pulse signal is inputted to the third terminal, wherein the second holding unit holds at least the control data of the second number of bits inputted to the any one of the second terminals at a timing when the delay unit delays the pulse signal by an amount at least equal to the second number of bits.

Further, the above-described aspect may also be configured such that the liquid droplet jetting head further includes a selection unit that selects output data to be outputted to the outside from the data inputted to the plurality of the second terminals and a data output terminal that outputs the data selected by the selection unit, wherein the control data are designation data designating the data to be selected by the selection unit.

Moreover, the above-described aspect may also be configured such that the liquid droplet jetting head further includes a selection unit that selects output data to be outputted to the outside from the data inputted to the plurality of the second terminals, wherein the control data are designation data designating the data to be selected by the selection unit, and any one of the second terminals outputs the data selected by the selection unit.

A liquid droplet jetting apparatus pertaining to an aspect of the present invention includes the liquid droplet jetting head pertaining to any of the aforementioned aspects.

Thus, the liquid droplet jetting apparatus pertaining to this aspect of the present invention can input control data to the liquid droplet jetting head without having to increase the number of terminals.

According to the aspects of the present invention, control data can be inputted without having to increase the number of terminals.

What is claimed is:

1. A liquid droplet jetting head comprising:

a first terminal to which is inputted a clock signal representing a synchronization timing when serially inputting data;

a second terminal to which are serially inputted liquid droplet jetting-related data of a first number of bits in synchronization with the clock signal inputted to the first terminal and to which are serially inputted control data of a second number of bits after the liquid droplet jetting-related data;

a third terminal to which is inputted a pulse signal when input of the input data to the second terminal is completed;

a first shift register that receives the liquid droplet jetting-related data of the first number of bits inputted to the second terminal;

a first holding unit that has a data storage area at least equal to the first number of bits and retrieves the liquid droplet jetting-related data of the first number of bits from the first register at a timing when the pulse signal is inputted to the third terminal;

a delay unit that delays the pulse signal inputted to the third terminal by an amount at least equal to the second number of bits in the clock signal;

a second shift register that receives the control data of the second number of bits inputted to the second terminal; and a second holding unit that has a data storage area at least equal to the second number of bits and retrieves at least the control data of the second number of bits from the second register at a delayed timing after the delay unit delays the pulse signal inputted to the third terminal by an amount at least equal to the second number of bits.

2. A liquid droplet jetting apparatus comprising the liquid droplet jetting head according to claim 1.

3. The liquid droplet jetting head according to claim 1, further comprising a selection unit that selects output data to be outputted from the data inputted to the second terminal and a data output terminal that outputs the data selected by the selection unit, wherein the control data are designation data designating the data to be selected by the selection unit.

4. The liquid droplet jetting head according to claim 1, further comprising a selection unit that selects output data to be outputted from the data inputted to the second terminal, wherein the control data are designation data designating the data to be selected by the selection unit, and the second terminal outputs the data selected by the selection unit.

5. A liquid droplet jetting head, comprising:

a first terminal to which is inputted a clock signal representing a synchronization timing when serially inputting data;

a plurality of second terminals, liquid droplet jetting-related data of a first number of bits being serially inputted at the same time to each of the plurality of second terminals in synchronization with the clock signal and control data of a second number of bits being serially inputted to any one of the plurality of second terminals after the liquid droplet jetting-related data;

a third terminal to which is inputted a pulse signal when input of the input data to the second terminal is completed;

a plurality of first holding units, the plurality of first holding units being disposed in correspondence to the plurality of second terminals and each first holding unit having a data storage area at least equal to the first number of bits;

a delay unit that delays the pulse signal inputted to the third terminal by an amount at least equal to the second number of bits in the clock signal; and a second holding unit that has a data storage area at least equal to the second number of bits, wherein each of the plurality of first holding units holds at least data of the first number of bits inputted to the corresponding second terminal at a timing when the pulse signal is inputted to the third terminal, and wherein the second holding unit holds at least the control data of the second number of bits inputted to the any one of the second terminals at a timing when the delay unit delays the pulse signal by an amount at least equal to the second number of bits.

6. The liquid droplet jetting head according to claim 5, further comprising a selection unit that selects output data to be outputted from the data inputted to the plurality of the second terminals and a data output terminal that outputs the data selected by the selection unit, wherein the control data are designation data designating the data to be selected by the selection unit.

7. The liquid droplet jetting head according to claim 5, further comprising a selection unit that selects output data to be outputted from the data inputted to the plurality of the second terminals, wherein the control data are designation data designating the data to be selected by the selection unit, and any one of the second terminals outputs the data selected by the selection unit.

* * * * *